US006220727B1

(12) United States Patent
Chang

(10) Patent No.: US 6,220,727 B1
(45) Date of Patent: Apr. 24, 2001

(54) REFLECTIVE MECHANISM FOR A COMPUTER-CONTROLLED STAGE LAMP

(76) Inventor: Ming-Cheng Chang, No. 10, Alley 48, Lane 5, Sheng Li Street, Yung Kang, Tainan Hsien (TW)

( * ) Notice: Subject to any disclaimer, the term of this patent is extended or adjusted under 35 U.S.C. 154(b) by 0 days.

(21) Appl. No.: 09/440,230

(22) Filed: Nov. 15, 1999

(51) Int. Cl.[7] ..... F21V 14/04
(52) U.S. Cl. ..... 362/284; 362/324; 362/346
(58) Field of Search ..... 362/35, 275, 280, 362/282, 284, 297, 322–324, 346; 359/876, 877

(56) References Cited

U.S. PATENT DOCUMENTS 4,868,721 * 9/1989 Soardo ..... 362/284
4,890,208 * 12/1989 Izenour ..... 362/284
4,931,916 * 6/1990 Callahan ..... 362/284
4,945,459 * 7/1990 Ferren et al. ..... 362/284
5,772,314 * 6/1998 Brumer ..... 362/324

* cited by examiner

*Primary Examiner*—Alan Cariaso
(74) *Attorney, Agent, or Firm*—Alan Kamrath; Rider, Bennett, Egan & Arundel, LLP

(57) ABSTRACT

A reflective mechanism is provided for a stage lamp providing an incident light. The reflective mechanism includes a first motor having a first output shaft rotating about a first axis and a second motor having a second output shaft rotating about a second axis that is parallel to the first axis. A support is drivable by the first output shaft to rotate about the first axis. A barrel includes a reflective mirror device mounted therearound for reflecting the incident light from the stage lamp. The barrel is mounted to the support and rotatable about a third axis that is perpendicular to the first axis. An endless toothed belt and gears are provided for transmitting power from the second output shaft to the support.

10 Claims, 10 Drawing Sheets

REFLECTIVE MECHANISM FOR A COMPUTER-CONTROLLED STAGE LAMP

BACKGROUND OF THE INVENTION

1. Field of the Invention

The present invention relates to a reflective mechanism for a computer-controlled stage lamp including universally rotatable motors to provide more colorful light effect.

2. Description of the Related Art

Sound effect and light effect are very important to stage performance. A good light effect provides a good background to the whole performance and makes the audience focus on the performer(s). A wide variety of stage lamps have heretofore been designed to provide desired light effect. A typical stage lamp, as shown in FIGS. 9 and 10 of the drawings, includes a computer-controlled lamp 6 with a light source (not shown) and a rotating disc (not shown) carrying various patterns thereon mounted in a casing 60 thereof. Light from the light source passes through a pattern on the rotating disc and a lens 61 and is thus incident to a reflective mechanism 7 from which the incident light is reflected, thereby providing colorful reflective images. The reflective mechanism 7 is mounted in a mounting section 62 of the casing 60 and includes a first motor 70 with an output shaft 701 extended through an inclined plate 63. A bracket 71 is securely attached to the output shaft 701 of the first motor 70 to rotate therewith. A second motor 72 is mounted to the bracket 71 and has an output shaft 721 to which a barrel 74 is mounted. A cylindrical mirror 74 means 741 (consisting of a plurality of mirror strips) is mounted to an outer periphery of the barrel 74 for reflecting incident light from the lens 61. The inclined plate 63 includes an opening 64 through which a wire 73 extends so as to be electrically connected to the second motor 72 for supplying power to the second motor 72. The output shaft 701 of the first motor 70 rotates about an axis X, and the output shaft 721 of the second motor 72 rotates about another axis Y that is perpendicular to the axis X. Thus, the barrel 74 with the cylindrical mirror 741 is expected to rotate universally such that the light, after passing through the lens 61, may be reflected by the mirror 741 to provide varying three-dimensional light images.

Nevertheless, rotational movements of the motors 70 and 72 must be limited to avoid entanglement of the wire 73 extended through the opening 64. In fact, the output shaft 701 of the motor 70 rotates in an interrupted way through a limited angle in opposite directions alternately instead of 360° rotation. In addition, the wire 73 tends to wear by peripheral edge of the opening 64 and thus results in a short circuit or open circuit. In addition, the first motor 70 has a relatively large load (the output shaft 701 carries the bracket 71, the second motor 72, and the barrel 74) and thus has a short life.

The present invention is intended to provide an improved reflective mechanism to solve these problems.

SUMMARY OF THE INVENTION

It is a primary object of the present invention to provide a reflective mechanism for a computer-controlled stage lamp that includes two universally rotatable motors to provide more colorful light effect and to lengthen the life of the motors.

In accordance with the present invention, a reflective mechanism is provided for a stage lamp providing an incident light. The reflective mechanism comprises:

a first motor having a first output shaft rotating about a first axis;

a second motor having a second output shaft rotating about a second axis that is parallel to the first axis;

a support drivable by the first output shaft to rotate about the first axis;

a barrel carrying a reflective mirror means mounted therearound for reflecting the incident light from the stage lamp, the barrel being mounted to the support and rotatable about a third axis that is perpendicular to the first axis; and means for transmitting power from the second output shaft to the barrel.

The stage lamp includes a casing with a mounting section in which the reflective mechanism is mounted. The mounting section of the casing includes an inclined plate. A fixing board is securely attached to the inclined plate. The first motor and the second motor are attached to the fixing board with the first output shaft and the second output shaft extended through the fixing board. An axle includes a first end coaxially engaged with the first output shaft to rotate therewith and a second end that extends through the support to operably engage with the barrel and thus drive the barrel.

In an embodiment of the invention, a gear seat is securely engaged to the second end of the axle. A first bevel gear is securely mounted to the gear seat to rotate therewith. The barrel includes a second bevel gear mounted to a side thereof and meshed with the first bevel gear such that rotation of the first output shaft causes rotation of the barrel about the third axis. The second output shaft includes a transmission gear coaxially engaged thereon to rotate therewith. A dry bearing is mounted around the axle. A follower gear is mounted around the dry bearing and securely engaged with the support to rotate therewith. An endless toothed belt is provided for transmitting power from the transmission gear to the follower gear.

The fixing board includes a side extension to which a detection board is securely attached. The detection board includes an infrared interrupter on an end thereof A sensor board is mounted around the axle and includes a notch defined in a peripheral edge thereof, the notch being within a detection range of the infrared interrupter. When the power supply to the reflective mechanism is shut off and restarted, the infrared interrupter on the detection board detects position of the notch on the sensor board relative to the infrared interrupter and then sends a feed-back signal to "zero" the output shaft of the motor. New operation modes can be activated according to the programs.

In another embodiment of the invention, the barrel is rotatably supported by a shaft, a first belt-driven wheel is securely mounted to the shaft to rotate therewith, and a second belt-driven wheel is securely engaged to the second end of the axle to rotate therewith. A transmission belt is wound around the belt-driven wheels, and a freely rotatable guide roller is provided to guide direction of the transmission belt.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
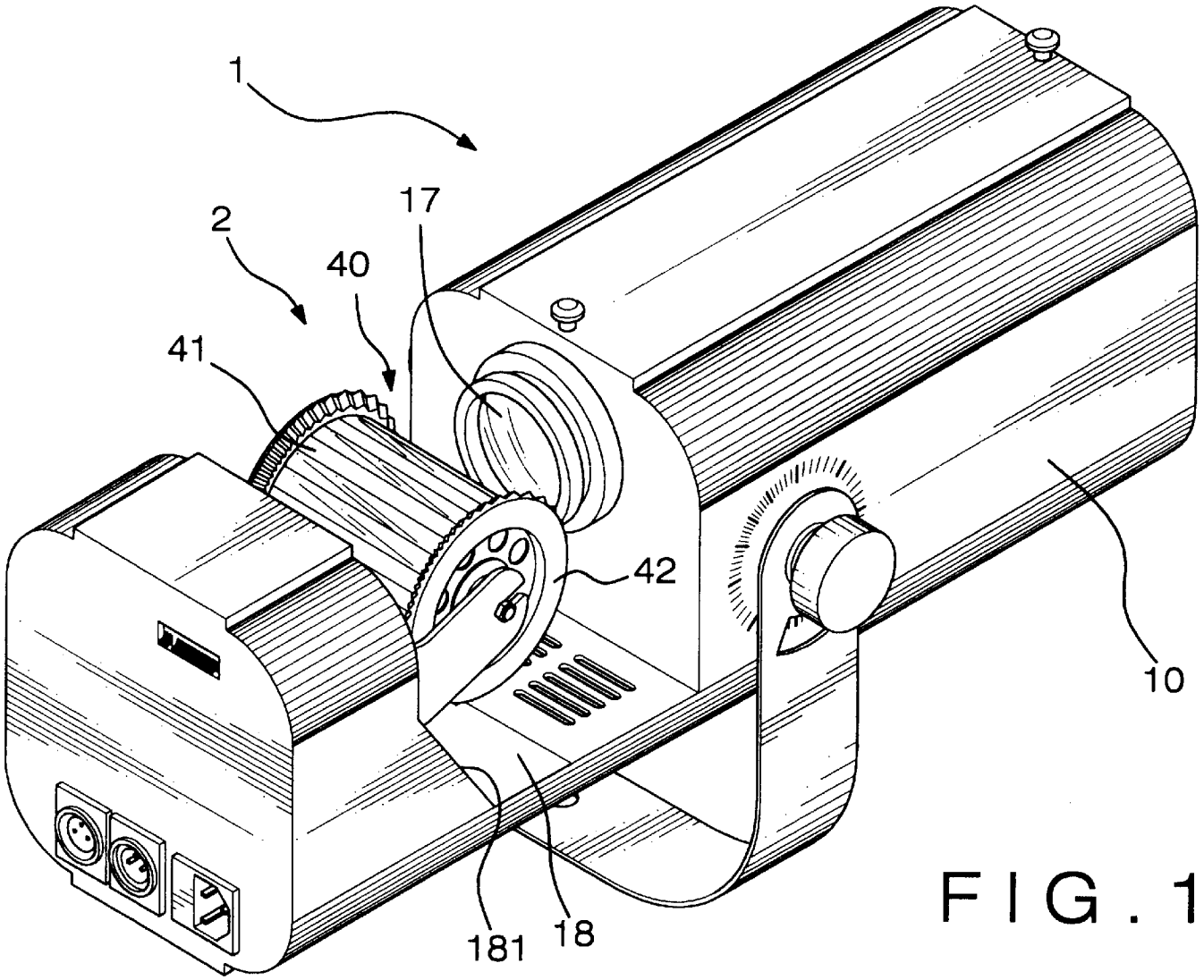
FIG. 1 is a perspective view of a computer-controlled stage lamp with a reflective mechanism in accordance with the present invention.
Figure 2:
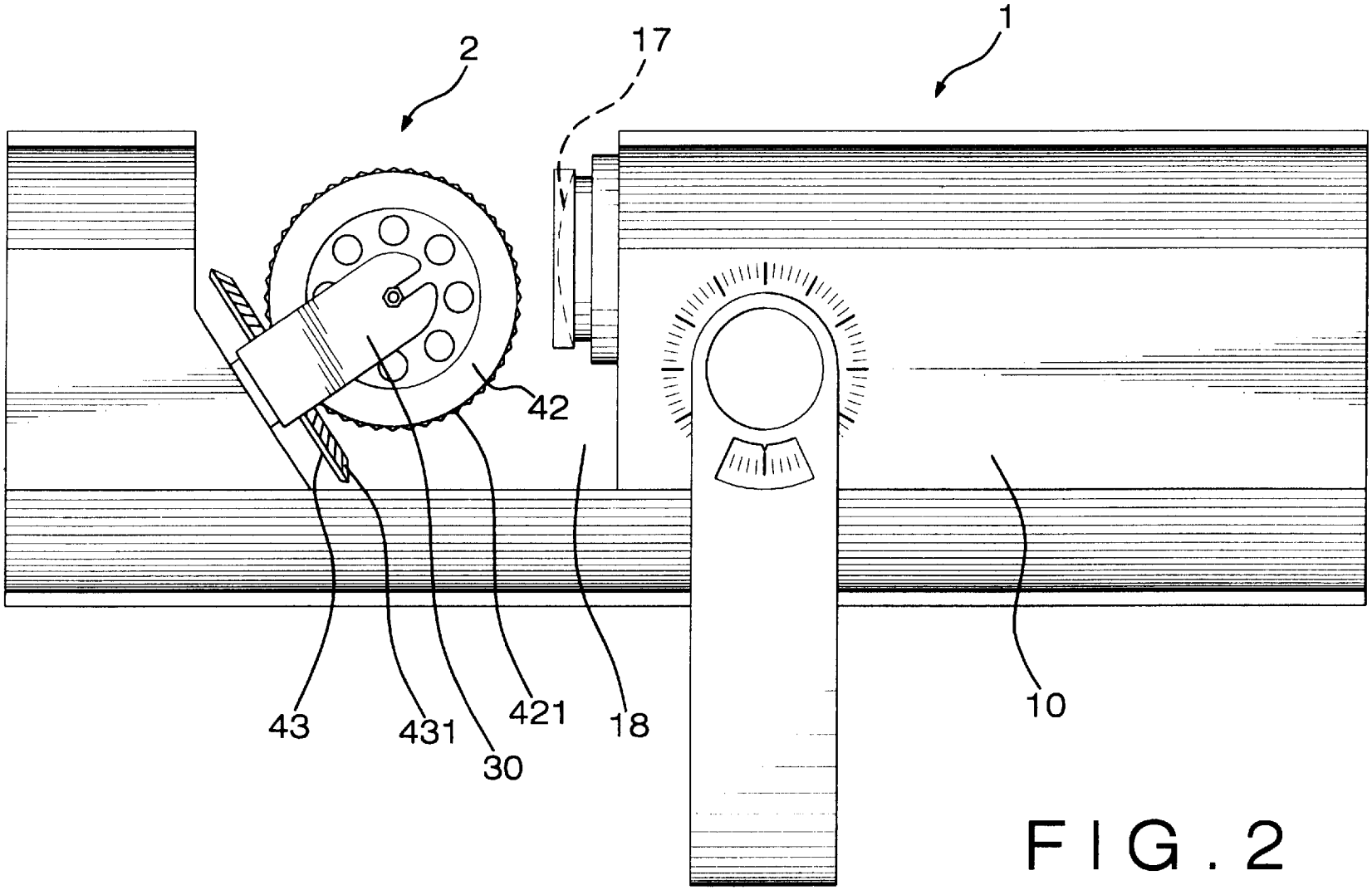
FIG. 2 is a side view of the computer-controlled stage lamp in accordance with the present invention.
Figure 3:
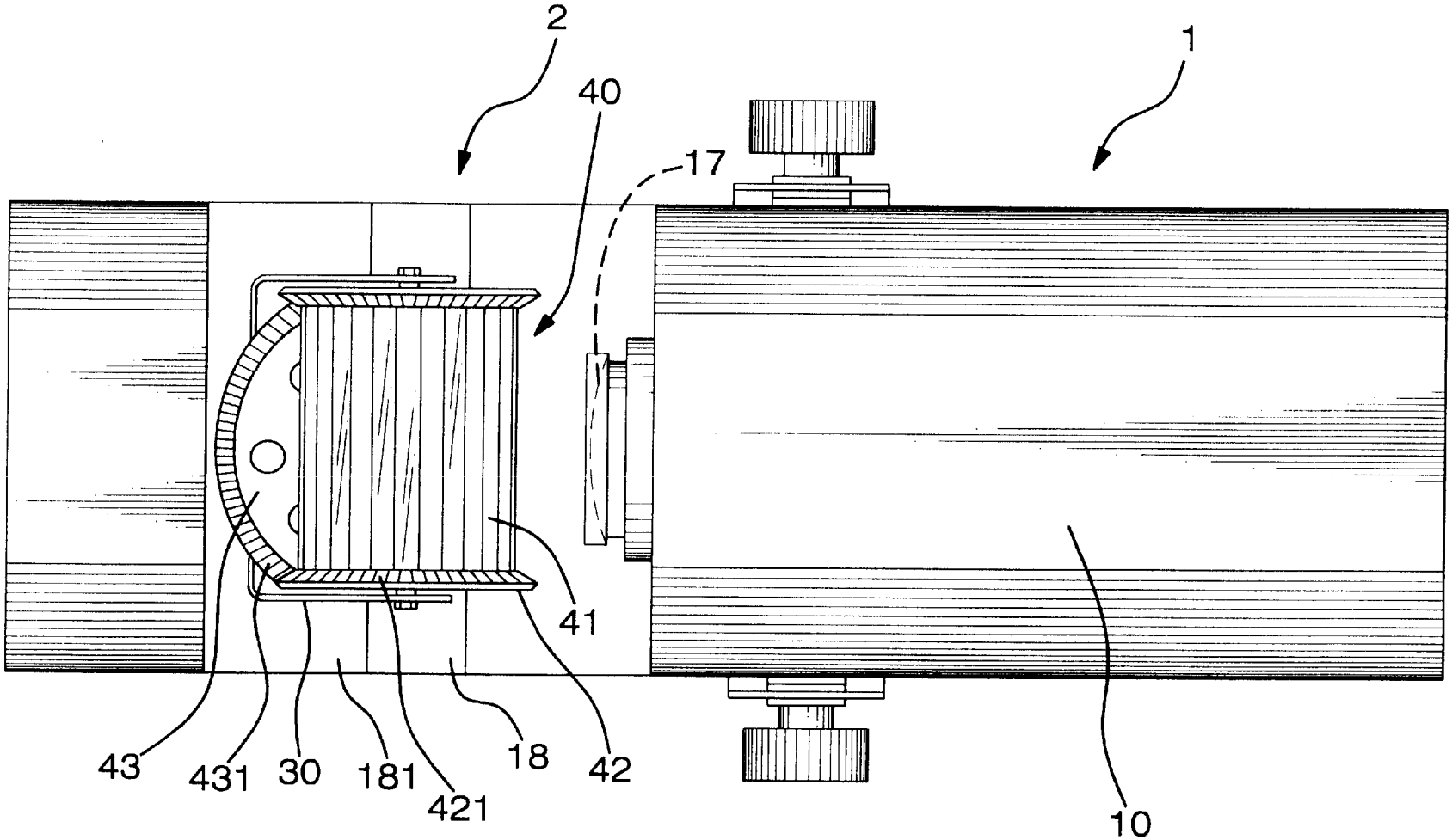
FIG. 3 is a top view of the computer-controlled stage lamp in accordance with the present invention.
Figure 4:
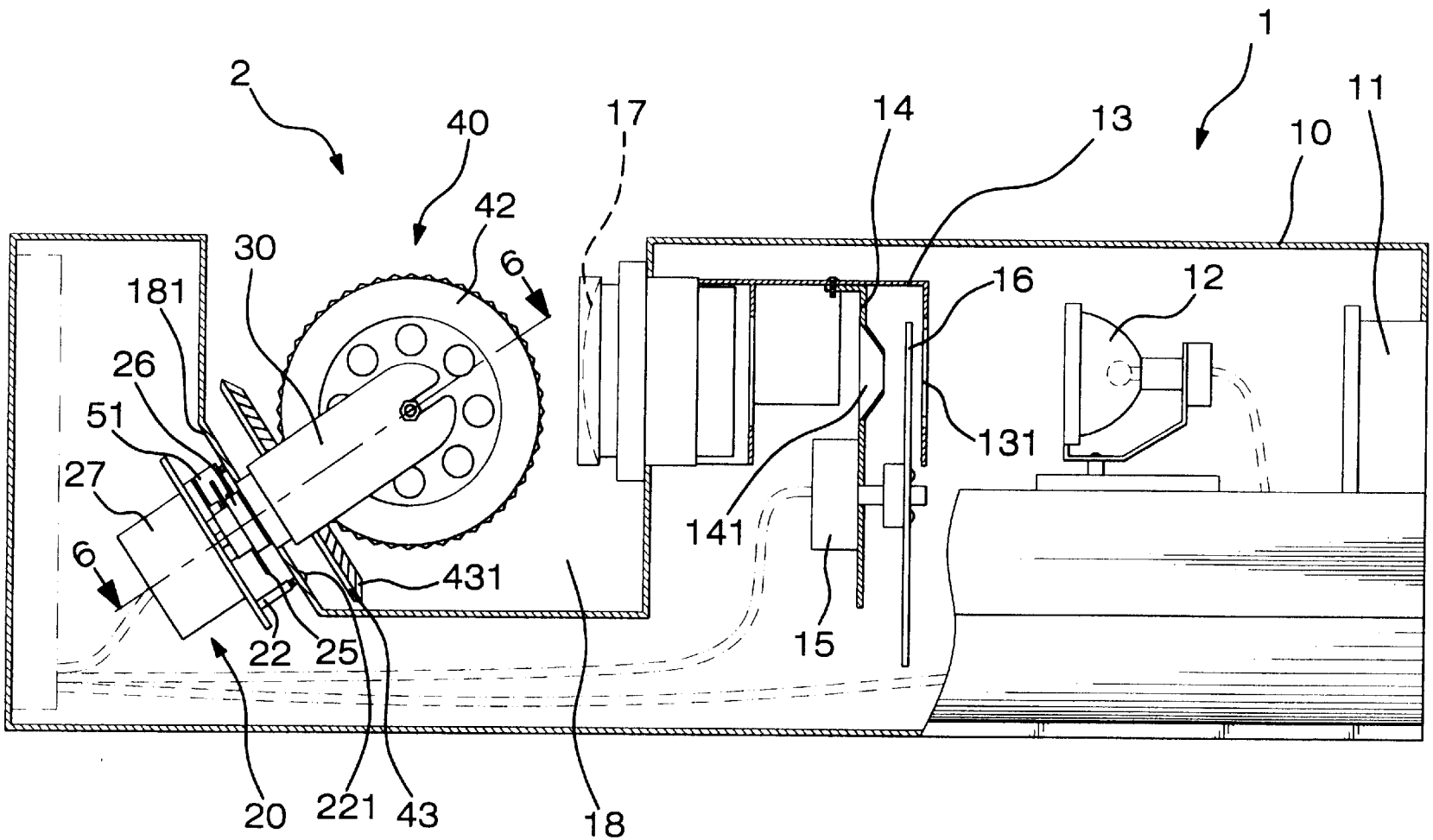
FIG. 4 is a longitudinal view of the computer-controlled stage lamp in accordance with the present invention.

Referring to FIGS. 1 through 8 and initially to FIGS. 1 through 3, a reflective mechanism 2 in accordance with the present invention is mounted in a casing 10 of a computer-controlled lamp 1. As illustrated in FIG. 4, the computer-controlled lamp 1 generally includes a fan 11, a light source 12, a rotational disc 16 carrying patterns thereon, and a lens 17. The rotational disc 16 is mounted to an output shaft (not labeled) of a motor 15 which, in turn, is mounted to a board 14 with a conic hole 141. A through-hole 131 is defined in a bracket 13 in the casing 10. The pattern on the rotational disc 16 is located between the through-hole 131 and the conic hole 141. Thus, light from the light source 12 passes through the through-hole 131, the pattern on the rotational disc 16, and the conic hole 141 and then transmits through the lens 17 and thus is incident to the reflective mechanism 2 that reflects the incident light to the stage.

Figure 5:
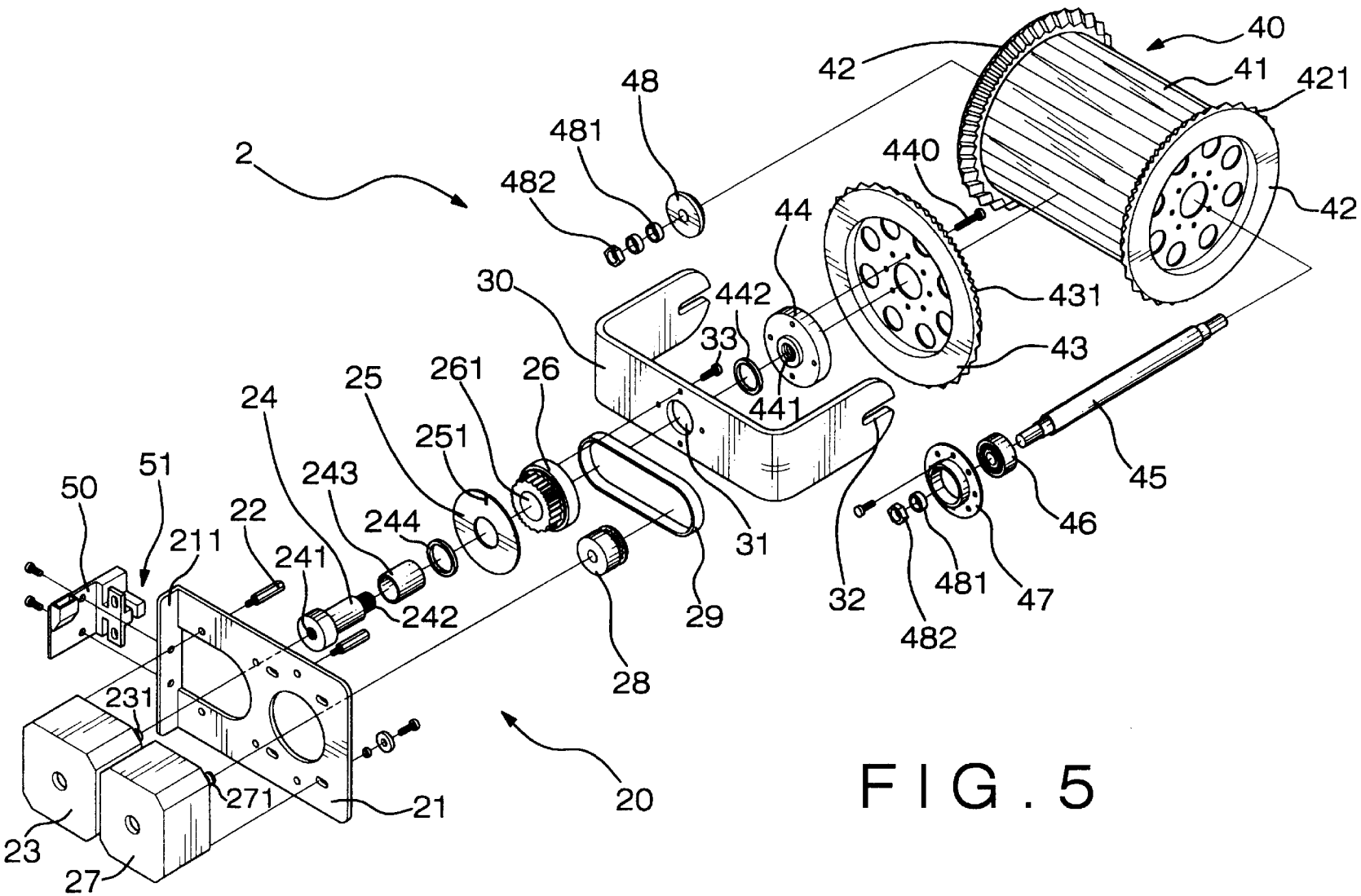
FIG. 5 is an exploded perspective view of the reflective mechanism in accordance with the present invention.
Figure 6:
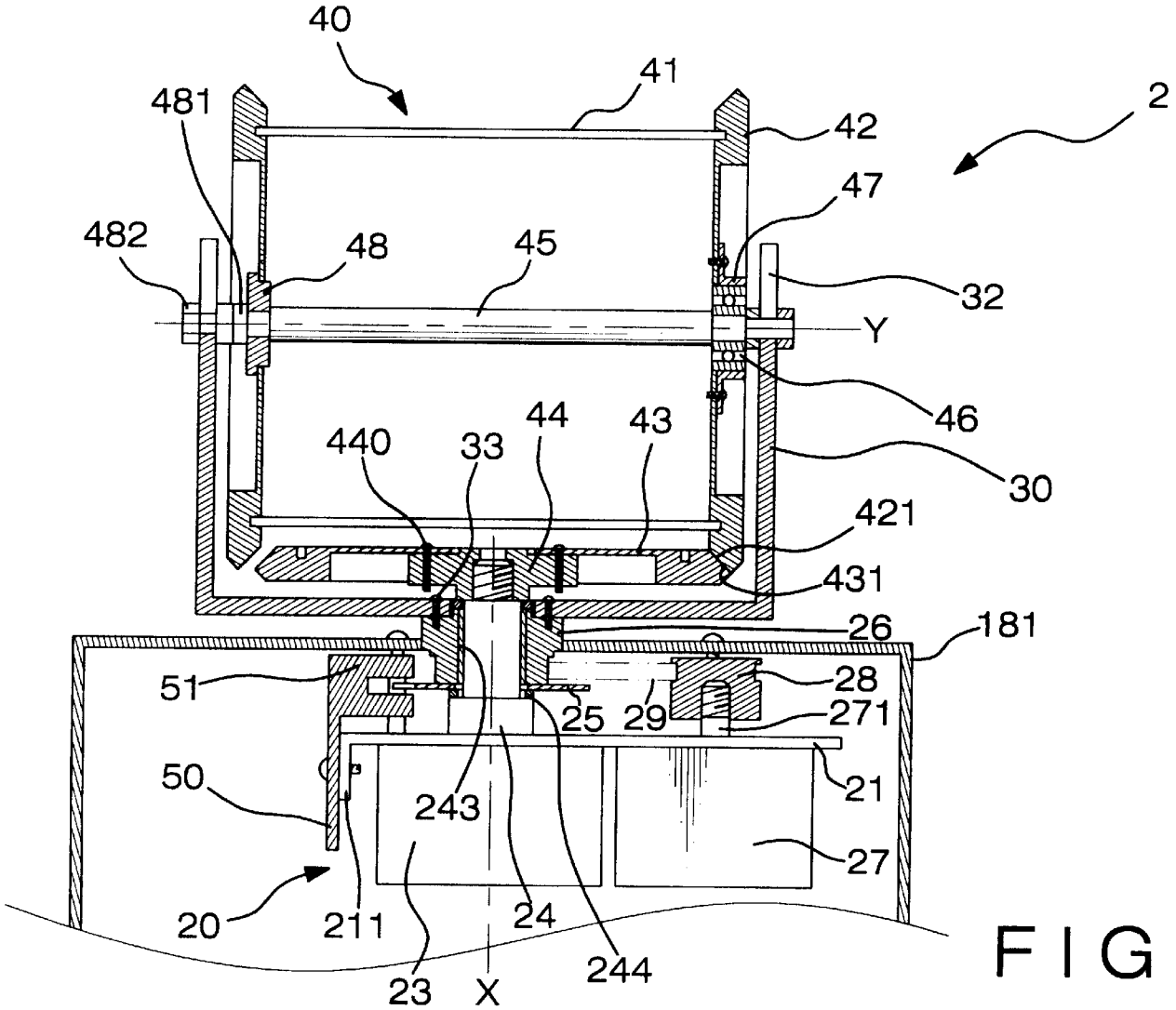
FIG. 6 is a sectional view taken along line 6—6 in FIG. 4.

The reflective mechanism 2 is mounted to an inclined plate 181 in a mounting section 18 of the casing 10. Referring to FIGS. 4 and 5, the reflective mechanism 2 includes a power means 20 consisting of two motors 23 and 27 mounted juxtaposed to each other. As illustrated in FIGS. 5 and 6, a fixing board 21 includes a number of positioning pegs 22 attached thereto, each positioning peg 22 having a first threaded end and a second end with a screw hole (not shown). The first threaded end of each positioning peg 22 is threadedly engaged with the fixing board 21 and the second end of each positioning peg 22 bears against a face of the inclined plate 181. A screw 221 (FIG. 4) is provided to engage with the screw hole in the second end of each positioning peg 22 to thereby securely attach the fixing board 21 to the inclined plate 181. The motors 23 and 27 are mounted to the fixing board 21 side by side such that the output shaft 231 of the motor 23 and the output shaft 271 of the motor 27 are parallel to each other.

Referring to FIGS. 4 through 6, an axle 24 includes a first enlarged end with a screw hole 241 that is coaxially and threadedly engaged with the output shaft 231 of the motor 23 to rotate therewith. A washer 244 and a sensor board 25 are securely mounted around the axle 24. A dry bearing 243 is mounted around the axle 24 and a follower bearing 26 is mounted around the dry bearing 243, best shown in FIG. 6. The axle 24 further includes a threaded second end 242, which will be described later. A transmission gear 28 is coaxially engaged with the output shaft 271 of the motor 27 to rotate therewith. The transmission gear 28 is connected with the follower gear 26 via an endless toothed belt 29 such that rotation of the transmission gear 28 causes rotation of the follower gear 26. A detection board 50 is secured to a side extension 211 of the fixing board 21. An infrared interrupter 51 is mounted to an end of the detection board 50. The sensor board 25 includes a notch 251 in a peripheral edge thereof The peripheral edge of the sensor board 25 is within the detection range of the infrared interrupter 51.

As illustrated in FIGS. 4 through 6, the axle 24 and the follower gear 26 extends beyond the inclined plate 181 (FIG. 6), wherein the second threaded end 242 of the axle 24 extends beyond a hole 31 (FIG. 5) of a support 30 for threadedly engaging with a screw hole 441 of a gear seat 44 (FIG. 5). A washer 442 is mounted around the second threaded end 242 of the axle 24. A bevel gear 43 is securely mounted to the gear seat 44 by bolts 440 to rotate therewith. Thus, rotation of the output shaft 231 of the motor 23 causes rotation of the bevel gear 44 via transmission of the axle 24 and the gear seat 44. Rotation of the output shaft 271 of the motor causes rotation of the support 30 via transmission of the gears 26 and 28 and the belt 29, since the support 30 is securely attached to the follower gear 26 by bolts 33 to rotate therewith.

Still referring to FIGS. 4 through 6, a barrel 40 is rotatably mounted to the support 30. In this embodiment, the barrel 40 includes reflective mirror strips 41 attached to an outer periphery thereof to thereby form a cylindrical reflective mirror means. A bevel gear 42 is formed on at least one end of the barrel 40. A bearing seat 47 and a bearing 46 are mounted in one of the bevel bears 42, and a shaft sleeve 48 is mounted in the other bevel gear 42. A shaft 45 is extended through the bearing 46 and the shaft sleeve 48 with two ends of the shaft 45 inserted into notches 32 (FIG. 5) in two limbs of the support 30, thereby allowing rotational movement of the barrel 40 relative to the support 30. Copper rings 481 and a nut 482 are provided to the other end of the shaft 45 to thereby retain the shaft 45 in place. As illustrated in FIG. 6, teeth 421 of one of the bevel gears 42 mesh with teeth 431 of the bevel gear 43. Thus, rotation of the output shaft 231 of the motor 23 causes rotation of the barrel 40 carrying the reflective mirrors 41 via transmission of the axle 24 and the bevel gears 43 and 42. As a result, the barrel 40 carrying the reflective mirror strips 41 rotates about an axis Y Rotation of the output shaft 271 of the motor 27 causes rotation of the support 30 via transmission of the gears 26 and 28 and the belt 29. As a result, the barrel 40 carrying the reflective mirror strips 41 rotates about an axis X that is perpendicular to the axis Y, best shown in FIG. 6.

When the power supply to the reflective mechanism 2 is shut off and restarted, the infrared interrupter 51 on the detection board 50 detects position of the notch 251 on the sensor board 25 relative to the infrared interrupter 51 and then sends a feed-back signal to "zero" the output shaft 231 of the motor 23. New operation modes can be activated according to the programs.

According to the above description, it is appreciated that the barrel 40 carrying the reflective mirror means may rotate universally to provide more colorful light images. Each motor 23, 27 operate independently and thus has a longer life. The zeroing design allows the stage lamp to provide expected light images. The performance effect is improved, since the performers may control the light effect.

Figure 7:
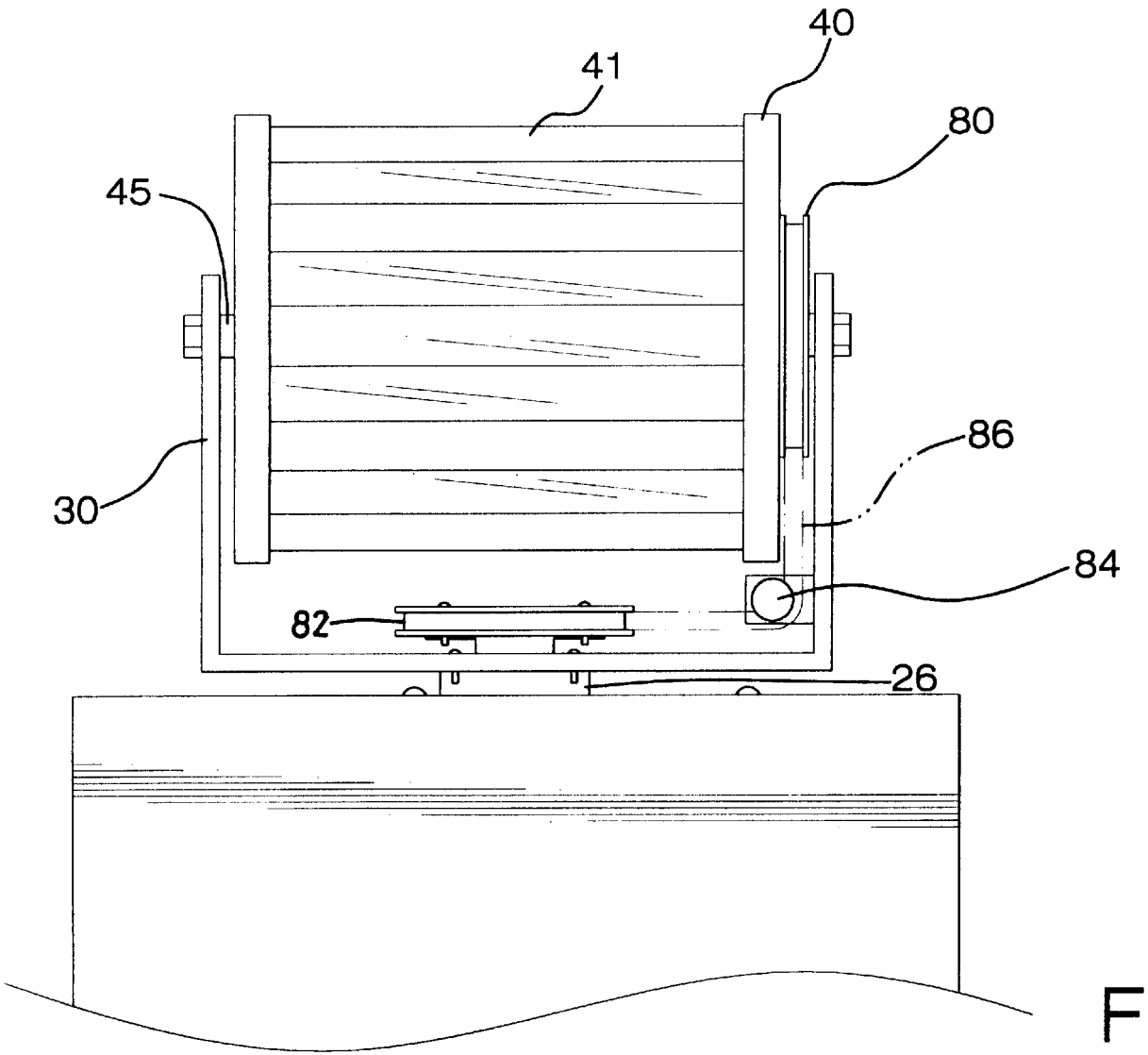
FIG. 7 is a top view illustrating a modified embodiment for transmitting power to a barrel of the reflective mechanism.
Figure 8:
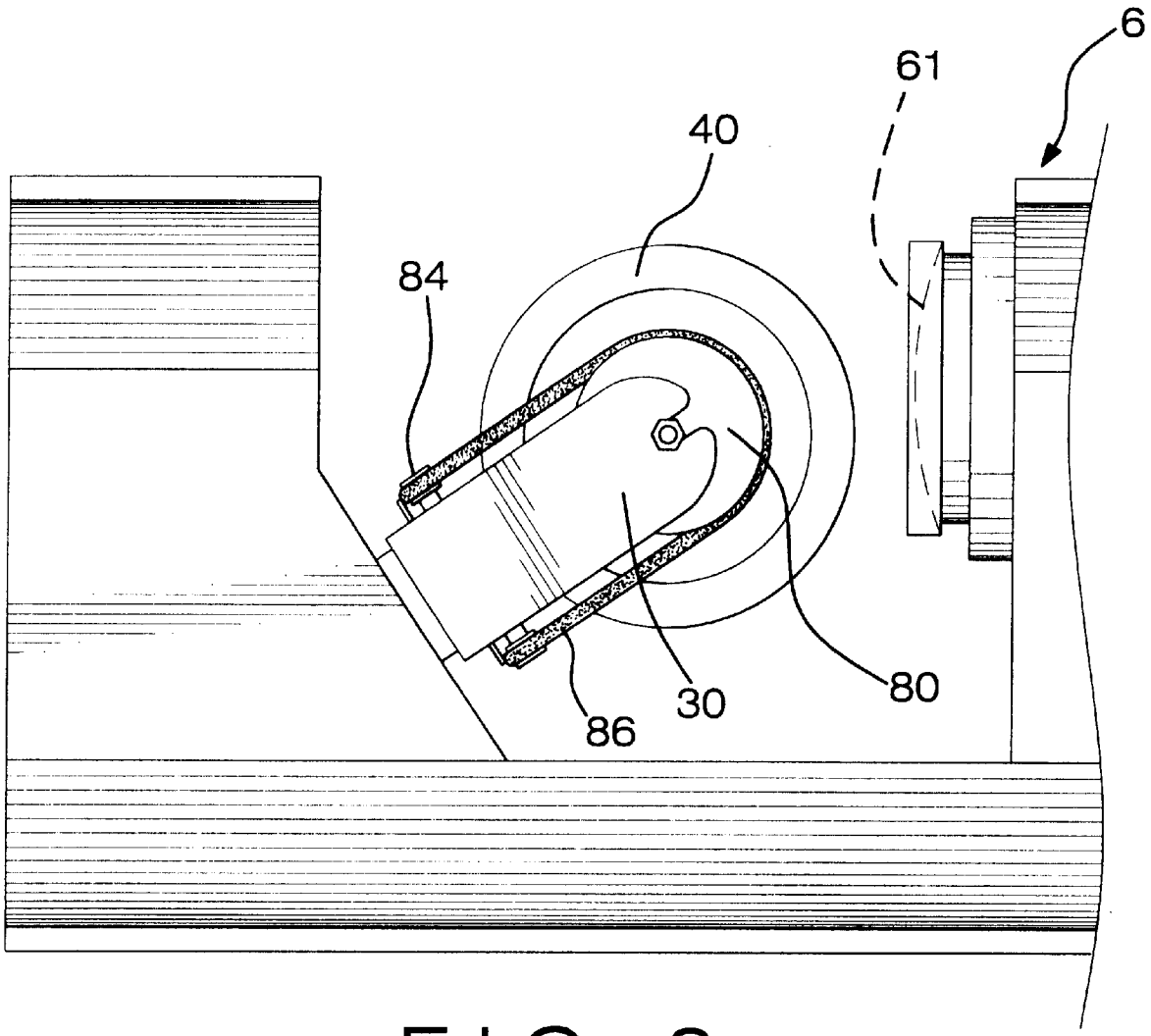
FIG. 8 is a side view of a portion of the stage lamp with the modified embodiment in FIG.
Figure 9:
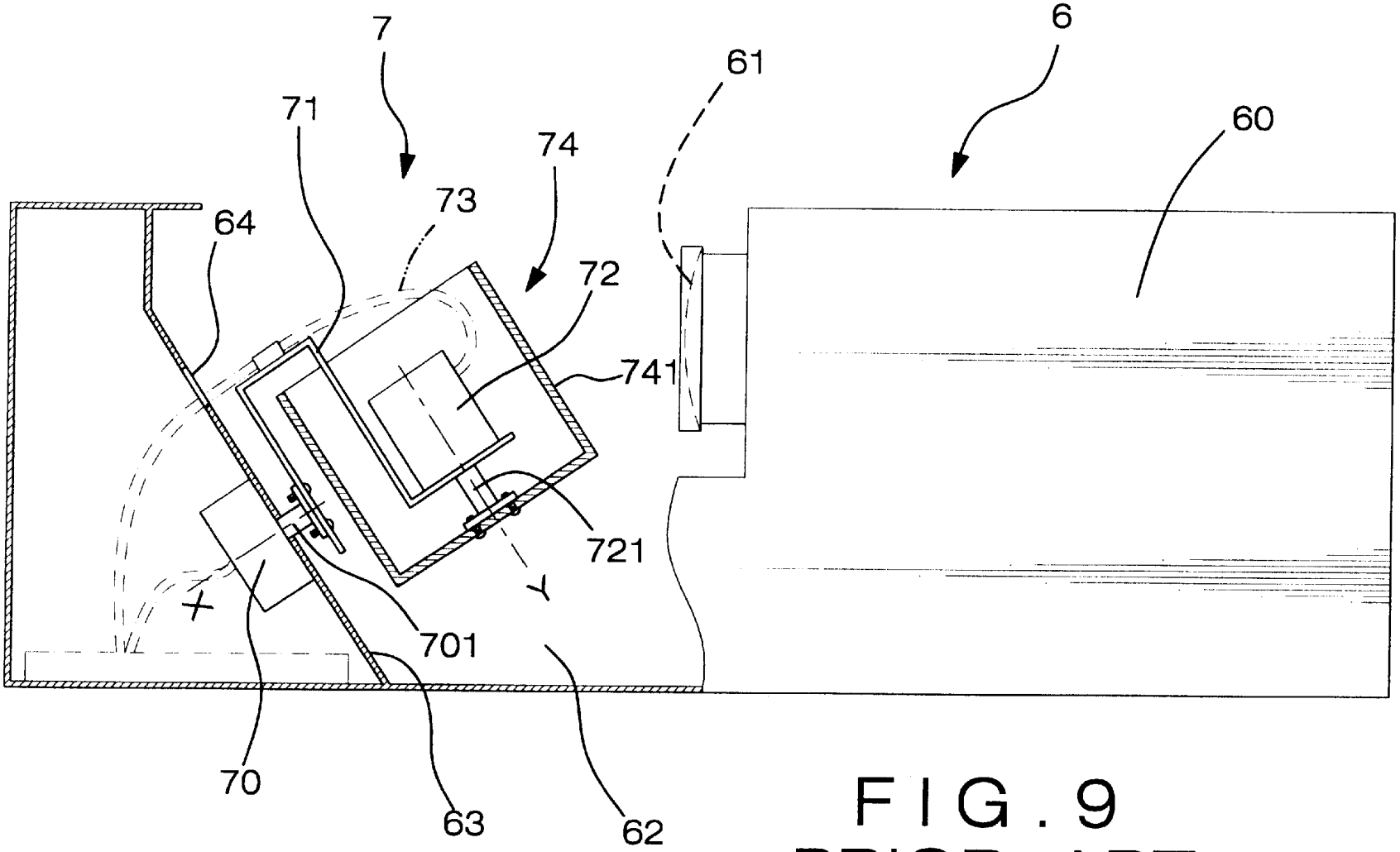
FIG. 9 PRIOR ART
FIG. 9 is a side view, partly sectioned, of a computer-controlled stage lamp with a conventional reflective mechanism.
Figure 10:
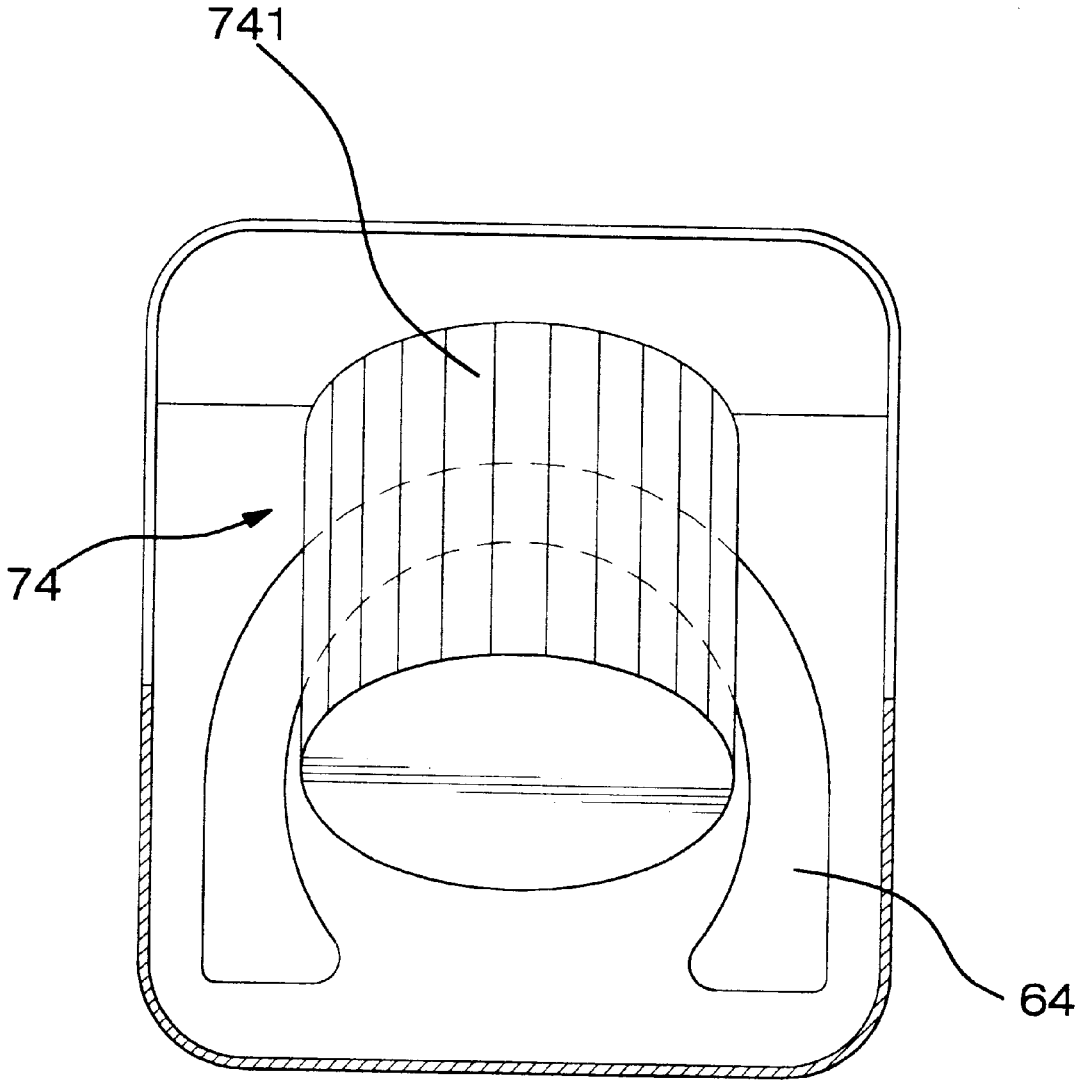
FIG. 10 PRIOR ART
FIG. 10 is a top view, partly sectioned, of a portion of the conventional reflective mechanism in FIG. 9.

FIGS. 7 and 8 illustrates a modified embodiment for transmitting power to the barrel 40 carrying the reflective mirror strips 41. The bevel gears 42 and 43 and corresponding elements in the first embodiment have been omitted. Instead, in this embodiment, a belt-driven wheel 80 is mounted around the shaft 45 to rotate therewith. Another belt-driven wheel 82 is securely engaged with the second end 242 of the axle 24 to rotate therewith. A freely rotatable guide roller 84 is provided to guide direction of a transmission belt 86 that is wound around the belt-driven wheels 80 and 82.

Although the invention has been explained in relation to its preferred embodiment, it is to be understood that many other possible modifications and variations can be made without departing from the spirit and scope of the invention as hereinafter claimed.

What is claimed is:

1. A reflective mechanism for a stage lamp providing an incident light, the reflective mechanism comprising:

a first motor having a first output shaft rotating about a first axis;

a second motor having a second output shaft rotating about a second axis that is parallel to the first axis;

a support drivable by the first output shaft to rotate about the first axis;

a barrel carrying a reflective mirror means mounted therearound for reflecting the incident light from the stage lamp, the barrel being mounted to the support and rotatable about a third axis that is perpendicular to the first axis; and means for transmitting power from the second output shaft to the barrel.

2. The reflective mechanism as claimed in claim 1, wherein the stage lamp includes a casing with a mounting section in which the reflective mechanism is mounted.

3. The reflective mechanism as claimed in claim 2, wherein the mounting section of the casing includes an inclined plate, further comprising a fixing board securely attached to the inclined plate, the first motor and the second motor being attached to the fixing board with the first output shaft and the second output shaft extended through the fixing board, an axle including a first end coaxially engaged with the first output shaft to rotate therewith and a second end that extends through the support to operably engage with the barrel and thus drive the barrel.

4. The reflective mechanism as claimed in claim 3, wherein a gear seat is securely engaged to the second end of the axle, a first bevel gear being securely mounted to the gear seat to rotate therewith, the barrel including a second bevel gear mounted to a side thereof and meshed with the first bevel gear such that rotation of the first output shaft causes rotation of the barrel about the third axis.

5. The reflective mechanism as claimed in claim 4, wherein the second output shaft includes a transmission gear coaxially engaged thereon to rotate therewith, further comprising a dry bearing mounted around the axle, a follower gear being mounted around the dry bearing and securely engaged with the support to rotate therewith, and means for transmitting power from the transmission gear to the follower gear.

6. The reflective mechanism as claimed in claim 5, wherein the transmission gear for transmitting power from the transmission gear to the follower gear is an endless toothed belt.

7. The reflective mechanism as claimed in claim 3, wherein the fixing board includes a side extension, further comprising a detection board securely attached to the side extension, the detection board including an infrared interrupter on an end thereof, a sensor board being mounted around the axle and including a notch defined in a peripheral edge thereof, the notch being within a detection range of the infrared interrupter.

8. The reflective mechanism as claimed in claim 3, wherein the barrel is rotatably supported by a shaft, a first belt-driven wheel being securely mounted to the shaft to rotate therewith, a second belt-driven wheel being securely engaged to the second end of the axle to rotate therewith, a transmission belt being wound around the belt-driven wheels, and a freely rotatable guide roller being provided to guide direction of the transmission belt.

9. The reflective mechanism as claimed in claim 8, wherein the second output shaft includes a transmission gear coaxially engaged thereon to rotate therewith, further comprising a dry bearing mounted around the axle, a follower gear being mounted around the dry bearing and securely engaged with the support to rotate therewith, and means for transmitting power from the transmission gear to the follower gear.

10. The reflective mechanism as claimed in claim 9, wherein the transmission gear for transmitting power from the transmission gear to the follower gear is an endless toothed belt.

* * * * *